US008550844B2

(12) United States Patent
Fujisaki

(10) Patent No.: US 8,550,844 B2
(45) Date of Patent: Oct. 8, 2013

(54) FLUIDPROOF CONNECTOR

(75) Inventor: Ryuichi Fujisaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 46 days.

(21) Appl. No.: 13/253,163

(22) Filed: Oct. 5, 2011

(65) Prior Publication Data

US 2012/0129392 A1 May 24, 2012

(30) Foreign Application Priority Data

Nov. 18, 2010 (JP) ..... 2010-258104

(51) Int. Cl.
*H01R 13/40* (2006.01)

(52) U.S. Cl.
USPC ..... 439/587

(58) Field of Classification Search
USPC ..... 439/587, 723, 724, 721
See application file for complete search history.

(56) References Cited

U.S. PATENT DOCUMENTS

| | | | | |
|---|---|---|---|---|
| 5,391,096 | A * | 2/1995 | Chiron et al. | 439/724 |
| 7,156,698 | B2 * | 1/2007 | Yamashita | 439/587 |
| 2005/0250364 | A1 | 11/2005 | Kameyama et al. | |

FOREIGN PATENT DOCUMENTS

| | | |
|---|---|---|
| EP | 1791223 A2 | 5/2007 |
| JP | 2007-287644 | 11/2007 |
| JP | 2007287644 | 11/2007 |

* cited by examiner

*Primary Examiner* — Phuong K T Dinh
(74) *Attorney, Agent, or Firm* — Gerald E. Hespos; Michael J. Porco; Matthew T. Hespos

(57) ABSTRACT

A waterproof (10) is provided with a capacitor (40); two busbars (35) connected via the capacitor (40). Each busbar (35) includes tabs (36), a coupling (37) connecting the tabs (36), and a connecting portion (38) connected to an electrode of the capacitor (40). A housing (11) houses the busbars (35) and the capacitor (40) and is open only in one direction. The housing (11) holds the terminal fittings inserted through an opening (12) of the housing (11) to be connected to the tabs (36) of the busbars (35). A seal (50) is press-fit into the housing (11) through the opening (12) and has through holes (51) through which the wires are closely inserted. A holder (60) having wire insertion holes (63) corresponding to the through holes (51) is mounted to cover the opening (12) of the housing (11) to retain and hold the seal (50).

14 Claims, 9 Drawing Sheets

FLUIDPROOF CONNECTOR

BACKGROUND OF THE INVENTION

1. Field of the Invention

The invention relates to a fluid or waterproof connector with a built-in electric element or component, such as a capacitor.

2. Description of the Related Art

Japanese Unexamined Patent Publication No. 2007-287644 discloses a joint connector with a built-in capacitor. The joint connector is used for collectively connecting wires arranged in an automotive vehicle and includes flat busbars. Each busbar has terminal portions to be connected to the wires are connected like comb teeth. The busbars are connected via the capacitor. The capacitor is fixed by soldering after lead wires are inserted and positioned at through holes formed in the busbars.

FIGS. 8 and 9 herein show a known waterproof connector 1 with a built-in capacitor. This connector 1 has a core 2 made of synthetic resin and busbars 3 are press-fit into the core 2. The connector 1 also has a capacitor 4 with lead wires 5 that are soldered to the busbars 3. The resulting assembly is inserted into a tubular housing 6. The housing 6 has a receptacle 7 and terminal portions 3A of the busbars 3 are pulled out into the receptacle 7. The housing 6 also has a capacitor-side space 8 opposite the receptacle 7 and the capacitor 4 is exposed in the capacitor-side space 8. An unillustrated potting material, such as epoxy resin, is filled into a capacitor-side space 8 to seal the capacitor-side space 8 and ensure a waterproof property.

However, the filled potting material may leak to the receptacle 7 through clearances between the core 2 and the housing 6 and between the core 2 and the press-fitted busbars 3. Further, epoxy resin is expensive and must be heated and then cured after being filled. Thus, a further cost reduction is required.

The invention was developed in view of the above situation and an object thereof is to provide a fluid or waterproof connector capable of ensuring a fluid or waterproof property by a simple construction and reducing a production cost.

SUMMARY OF THE INVENTION

The invention relates to a fluid or waterproof connector with an electric element or component, such as a capacitor, and at least one busbar connected to the electric element. The busbar includes one or more tabs connectable to one or more mating terminal fittings connected to ends of wires. The connector also has a housing that houses the busbar and the electric element connected to the busbar. The housing is open in only one direction and holds the terminal fittings inserted through an opening for connection to the tabs of the busbar piece. A seal is press-fit into the housing through the opening of the housing and has one or more through holes through which the wires are to be closely inserted. A holder at least partly covers the opening of the housing and retains the seal. The holder has wire insertion holes that correspond to the through holes of the seal.

The at least one busbar may comprise two busbars connected via the electric element.

The busbar preferably has tabs, a coupling connecting the tabs to each other, and a connecting portion connected to an electrode of the electric element. The tabs of the busbar are connectable to mating terminal fittings that are connected to ends of wires.

The above-described connector achieves fluid or watertightness in the housing with a simple inexpensive construction that houses the busbars and the capacitor in the housing that is open in only one direction and seals the opening of the housing by the seal. As described above, the conventional connector ensures watertightness of a connector by filling a potting material, such as epoxy resin, into a housing. However, there is a possibility that the potting material will leak through clearances between busbars and the housing. Thus, a production cost of the prior art connector may be increased due to a molding failure resulting from this possibility. Further, the required steps of heating and curing the filled epoxy resin make production efficiency poor. Additionally, the epoxy resin itself is expensive. In contrast, the connector of the invention does not require filling of a potting material, such as epoxy resin. Rather, watertightness can be ensured merely by the housing and the seal. Thus, a material cost and a processing cost can be reduced and a molding failure can be avoided.

The connector housing preferably includes an outer housing that is open only in one direction and an inner housing to be housed in the outer housing.

The inner housing preferably includes a male housing for holding the busbars penetrating therethrough and a female housing to be connected to the male housing and including one or more cavities for individually housing the one or more tabs.

The housing preferably has an outer housing that is open only in one direction and an inner housing to be housed in the outer housing. The inner housing includes a male housing for holding the busbars and a female housing to be connected to the male housing and including cavities for housing the tabs. The housing is made of a plurality of members so that formability is good, thereby contributing to a reduction in production cost. Further, a design change and an application to an existing connector are easily possible if the construction of the inner housing is changed according to the constructions and shapes of the busbars and the capacitor. Thus, general versatility can be improved.

The male housing preferably includes a main portion for holding the busbars by insert molding and an electric element housing for housing the electric component by supports that support and sandwich an element main body of the electric element in cooperation with a receiving portion of the outer housing project from the electric element housing.

The electric element is constructed such that two lead wires are led out from an element main body. The lead wires are connected to respective connecting portions of the busbars by welding.

The capacitor preferably has two lead wires led out from a capacitor main body. The lead wires are connected to the connecting portions by welding. In recent years, solder used for soldering has been progressively made lead-free in view of an environmental load. If the lead wires of the capacitor and the coupling connecting portions of the busbar pieces are soldered using this lead-free solder, connection reliability may be reduced. However, connection reliability can be improved by connecting the lead wires of the capacitor and the connecting portions of the busbar pieces by welding. Further, the weight and material cost of the solder used in the case of soldering can be reduced, thereby contributing to weight saving and a production cost reduction.

Two busbars are arranged to substantially face each other with the electric element arranged between the busbars.

Each busbar preferably includes a cantilevered clamping piece.

The element main body preferably is clamped between the busbars by the respective clamping pieces that substantially face each other.

The busbars may be arranged to face each other with the capacitor arranged between the busbars. Each busbar may include a cantilevered clamping piece. The capacitor main body may be clamped between the busbars by the respective clamping pieces arranged to face each other. According to this construction, the capacitor can be positioned between the busbars by a simple construction and work efficiency at the time of electrical connection by soldering, welding or the like can be improved.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
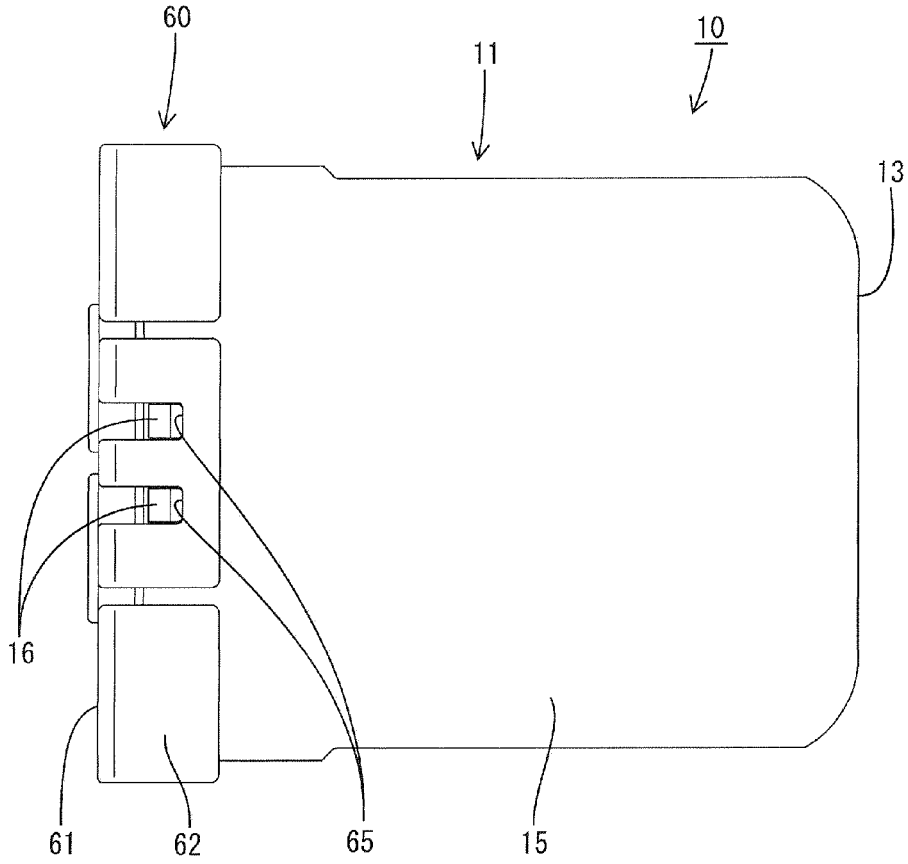
FIG. 1 is a side view of a waterproof connector according to one embodiment of the present invention.
Figure 2:
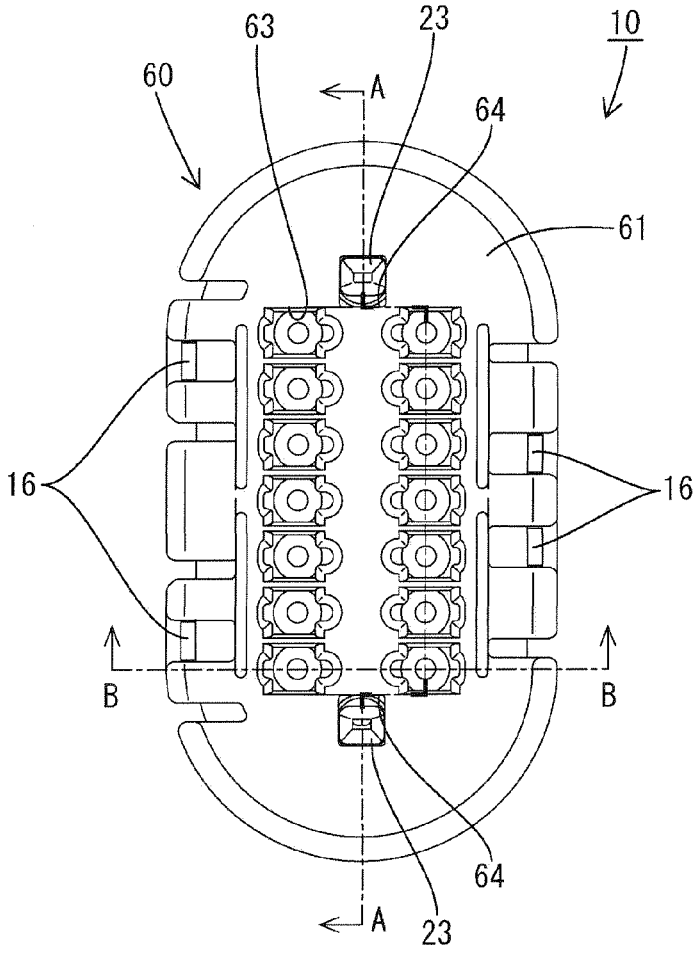
FIG. 2 is a front view of the waterproof connector.

A waterproof connector in accordance with the invention is identified generally by the numeral 10 in FIGS. 1 to 4. The waterproof connector 10 includes an outer housing 11 with an opening 12 at one end and a bottom wall 13 opposite the opening 12. The end of outer housing 11 with the opening can be connected to a mating connector and is referred to herein as the front end. The end with the bottom wall 13 is referred to as a rear end.

The outer housing 11 is made e.g. of synthetic resin and is substantially in the form of a bag or cup that is open only in one direction. The opening 12 has a substantially elliptical or rounded shape. A substantially block-shaped receiving portion 14 projects from the bottom wall 13 toward the opening 12. A side wall 15 extends unitarily from the bottom wall 13 and an end of the side wall 15 opposite the bottom wall 13 defines the opening 12. Locking projections 16 project from the side wall 15 near the opening 12.

Figure 6:
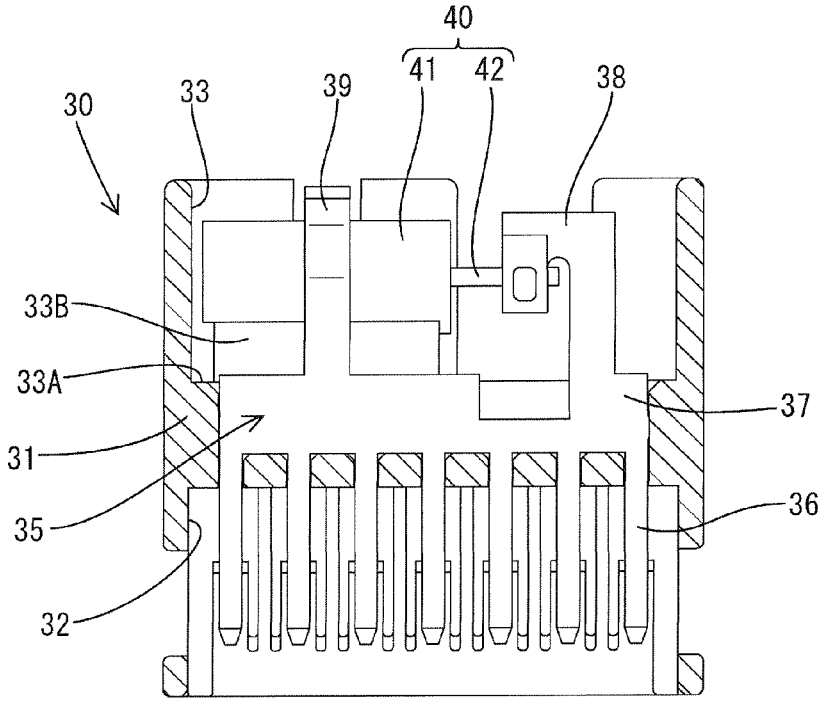
FIG. 6 is a section along C-C of FIG. 5.

The waterproof connector 10 includes two busbars 35 formed by punching out, stamping or cutting an electrically conductive plate, such as a metal plate, as shown in FIG. 6. Each busbar 35 has tabs 36 that project like comb teeth from a coupling 37. A connecting portion 38 and a clamping piece 39 project back from each coupling 37. Two clamping pieces 39 have dogleg shapes and are bent so that their leading ends approach each other.

An inner housing 20 is housed in the outer housing 11 and includes a female housing 21 made e.g. of synthetic resin. Cavities 22 penetrate the female housing 21 in forward and backward directions in stages and partition walls 22A partition the cavities 22 from one another. An unillustrated mating terminal fitting connected to an end of a wire can be inserted through a front opening 22B at the front end of each cavity 22. A rear opening 22C is defined at the rear end of each cavity 22 and has a guiding surface 22D inclined or converging toward the cavity 22 so that the tabs 36 of the busbars 35 can be guided into the cavity 22 when the waterproof connector 10 is assembled. Locks 23 project forward from the female housing 21.

Figure 5:
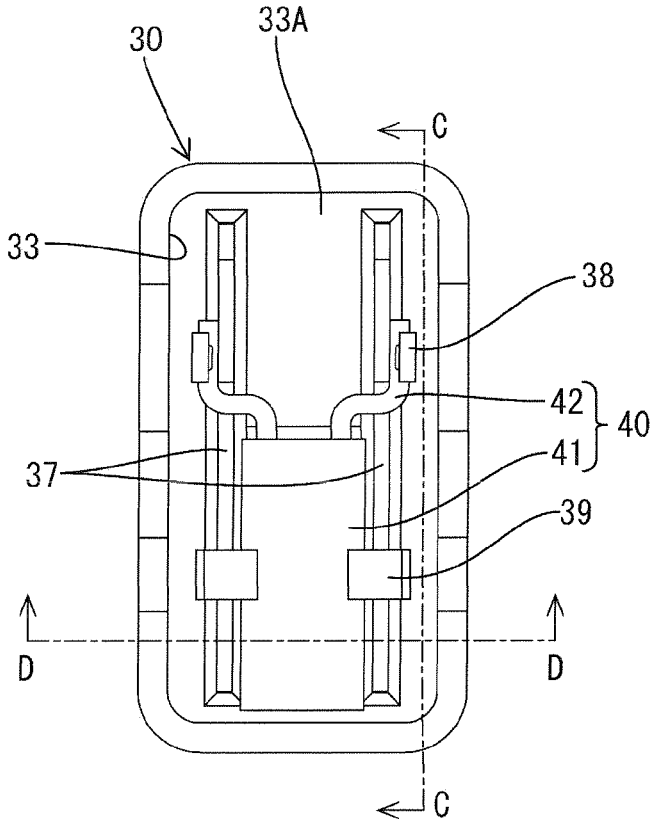
FIG. 5 is a rear view of a male housing.
Figure 7:
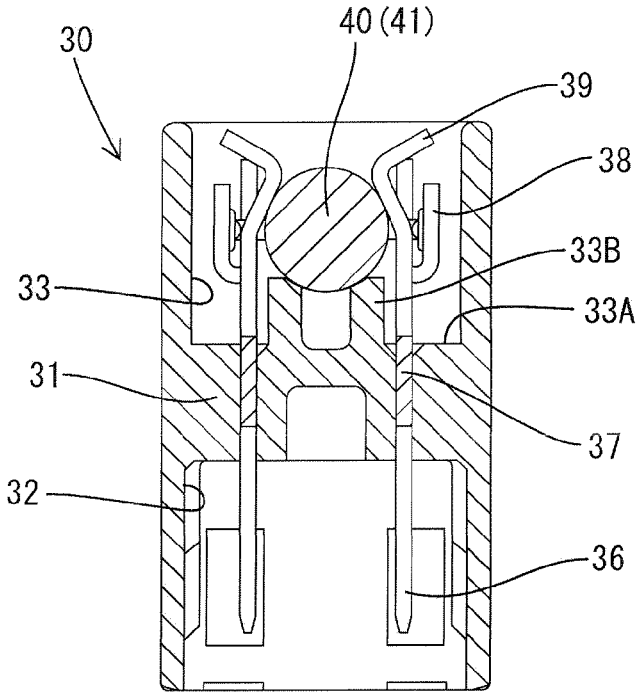
FIG. 7 is a section along D-D of FIG. 5.
Figure 8:
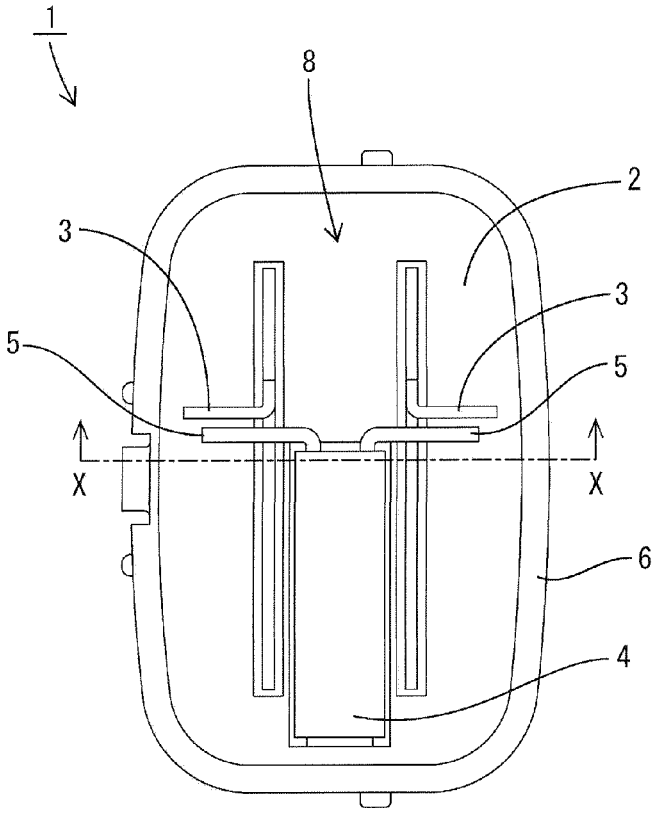
FIG. 8 PRIOR ART
FIG. 8 is a rear view of a prior art connector.
Figure 9:
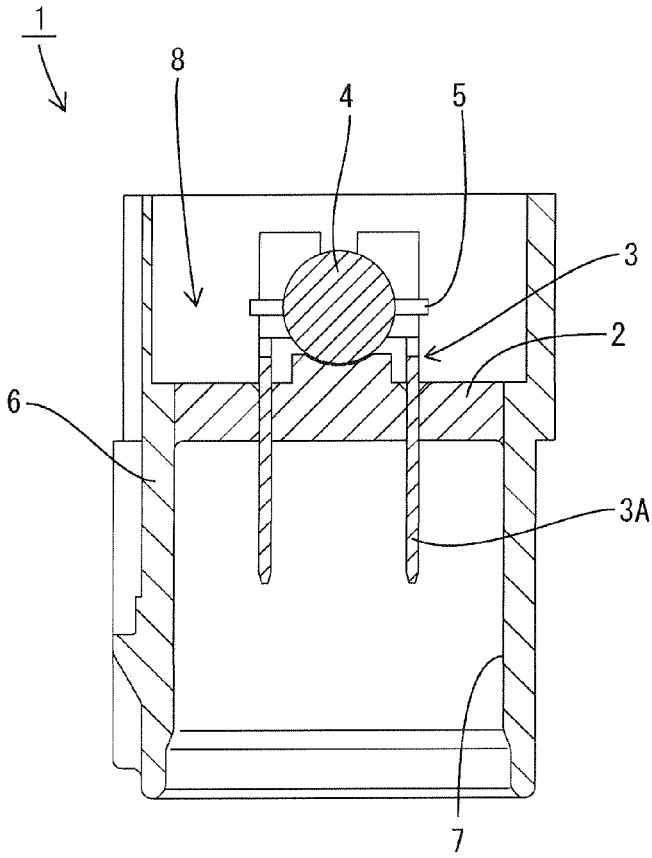
FIG. 9 PRIOR ART
FIG. 9 is a section along X-X of FIG. 8.

The inner housing 20 also has a male housing 30, which is illustrated in FIGS. 5 to 7. The male housing 30 is made e.g. of synthetic resin and includes a main portion 31. The couplings 37 of the busbars 35 are insert molded into the main portion 31 of the male housing 30 so that the busbars 35 face one another, as shown in FIG. 7. A receptacle 32 projects forward from the main portion 31 and surrounds the tabs 36 of the busbars 35 and a capacitor housing 33 projects rearward from the main portion 31 and surrounds for at least partly housing the capacitor 40. The receptacle 32 is in the form of a tube with an open front end, and the female housing 21 is to be fit therein. A capacitor housing 33 projects rearward from the main portion 31 and has a back surface 33A at the main portion 31. Supports 33B project from the back surface 33A. The capacitor housing 33 surrounds the connecting portions 38 and the clamping pieces 39 that project back from the couplings 37 of the respective busbars 35.

The waterproof connector 10 also includes a capacitor 40 that includes a substantially cylindrical capacitor main body 41 and two lead wires 42 that extend out from one end of the capacitor main body 41. The lead wires 42 are round pins that are led out substantially perpendicularly from the one end of the capacitor main body 41. The lead wires 42 then are bent in directions substantially away from each other. The capacitor 40 is mounted in the capacitor housing 33 of the male housing 30 so that the supports 33B of the capacitor housing 33 support or sandwich the capacitor main body 41 of the capacitor 40 in cooperation with the receiving portion 14 of the outer housing 11. The two clamping pieces 39 of the busbars 35 have dogleg shapes and are bent so that their leading ends approach each other to clamp or position the capacitor main body 41 from substantially opposite sides. Additionally, the extending ends of the lead wires 42 are connected to the connecting portions 38 of the busbars 31. More particularly, the connecting portions 38 of the busbars 35 extend along an extending direction of the lead wires 42 and contact the lead wires 42 from the outer sides. Furthermore, the connecting portions 38 of the busbars 35 are fixed to the respective lead wires 42 e.g. by welding, soldering, gluing or the like.

The waterproof connector 10 also has a seal 50 that is press-fit through the opening 12 of the outer housing 11. More particularly, the seal 50 is a one-piece plug made of a resilient material, such as rubber or a gelatinous material, in the form of a thick plate. Through holes 51 penetrate the seal 50 in forward and backward directions to allow the insertion of wires. The through holes 51 are disposed to correspond to the cavities 22 of the female housing 21. Lock-piece insertion holes 52 penetrate the seal 50 at the opposite longitudinal sides of the through holes 51 and allow the insertion of the locks 23 of the female housing 21. The seal 50 is held in close contact with the inner peripheral surface of the opening 12 to provide watertight sealing between the outer housing 11 and the seal 50 when the seal 50 is press-fit into the outer housing 11. The wires inserted through the through holes 51 and the locks 23 inserted through the lock insertion holes 52 also are sealed in a fluid or watertight manner.

Figure 3:
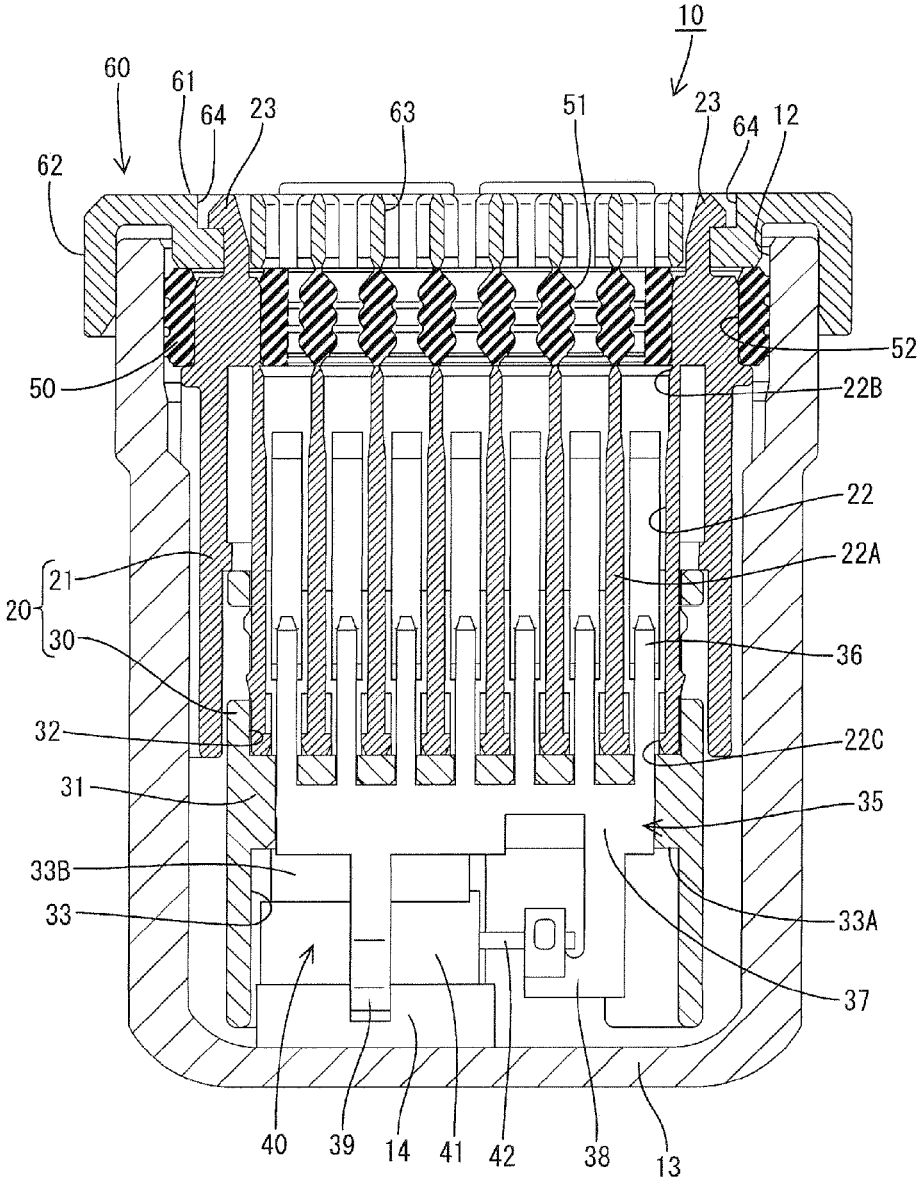
FIG. 3 is a section along A-A of FIG. 2.
Figure 4:
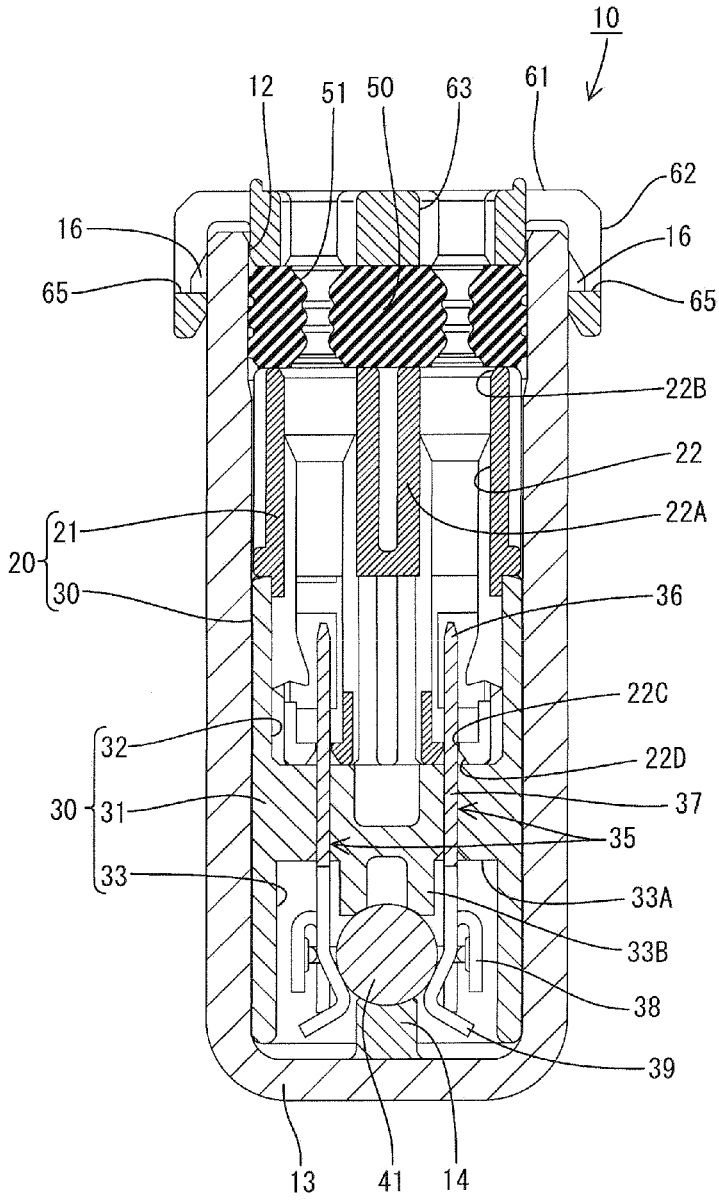
FIG. 4 is a section along B-B of FIG. 2.

The waterproof connector 10 also includes a holder 60 that is made e.g. of synthetic resin and that is mounted at the opening 12 of the outer housing 11 to cover the opening 12 and to hold the seal 50 in place. The holder 60 includes a wire pull-out portion 61 that faces the bottom wall 13 of the outer housing 11. The wire pull-out portion 61 is configured for at least partly closing the opening 12. Locks 62 project from the outer periphery of the wire pull-out portion 61 and engage the locking projections 16 of the outer housing 11. Wire insertion holes 63 penetrate the wire pull-out portion 61 in forward and backward directions, as shown in FIGS. 3 and 4, and the number and positions of the wire insertion holes 63 substantially correspond to the cavities 22 of the female housing 21 and the through holes 51 in the seal 50. Wires connected to one or more corresponding mating terminal fittings can be pulled out of the waterproof connector 10 through the wire insertion holes 63.

Two engaging portions 64 penetrate the wire pull-out portion 61 in forward and backward directions and are arranged at opposite sides of the wire insertion holes 63. The locks 23 of the female housing 21 are engaged with the engaging portions 64 so that the female housing 21 and the male housing 30 fit in the female housing 21 are fixed to the rear holder 60. Locking grooves 65 are formed at two positions of each lock 62 and extend in a longitudinal direction. The locking projections 16 of the outer housing 11 engage with the locking grooves 65 to secure the holder 60 on the outer housing 11.

To assemble the fluid or waterproof connector 10, the capacitor 40 is mounted in the male housing 30. Specifically, the capacitor main body 41 of the capacitor 40 is placed on the supports 33B of the capacitor housing 33 and is held by the clamping pieces 39. The lead wires 42 of the properly positioned capacitor 40 are connected (e.g. welded, laser welded, soldered or glued) to the connecting portions 38 of the busbars 35. Thus, the busbars 35 are connected electrically via the capacitor 40.

The female housing 21 subsequently is fit into the receptacle 32 of the male housing 30 so that the tabs 36 are guided by the respective guiding surfaces 22D through the rear openings 22C of the corresponding cavities 22 to be positioned. The assembled inner housing 20 is placed into the outer housing 11. The seal 50 then is press-fit into the opening 12 of the outer housing 11 and the holder 60 is mounted to complete the assembling of the waterproof connector 10. More particularly, the female housing 21 is fixed to the holder 60 via the seal 50 by engaging the lock pieces 23 with the engaging portions 64 of the rear holder 60. Further, the locking projections 16 projecting form the outer housing 11 are engaged with the locking grooves 65 formed in the rear holder 60. As a result, the rear holder 60 is mounted on the outer housing 11 so as not to be pulled out.

Although not shown, mating terminal fittings are held in the respective cavities 22 of the female housing 21 and are connected to the tab portions 36. The wires connected to these terminal fittings are pulled out of the waterproof connector 10 through the respective through holes 51 of the seal 50 and the respective wire insertion holes 63 of the holder 60. Clearances between the pulled-out wires and the through holes 51 of the seal 50 are sealed in a fluid or watertight manner and clearances between the locks 23 penetrating through the seal 50 and the lock-piece through holes 52 also are sealed in a fluid or watertight manner. Thus, fluid or watertightness in the outer housing 11 having the inner housing 20 housed therein is ensured by the seal 50.

As described above, fluid or watertightness in the outer housing 11 can be ensured by a simple construction of housing the inner housing 20 including the two busbars 35 connected via the capacitor 40 into the outer housing 11 including the opening 12 only in one direction and sealing the opening 12 by the arranged or press-fitted seal 50 and, further, a production cost can be reduced. In the conventional case of ensuring fluid or watertightness of a connector, for example, by filling a potting material such as epoxy resin into a housing, there is a possibility that the potting material leaks, for example, through clearances formed between busbars and the housing and a production cost may be increased due to a molding failure resulting from this possibility. Further, in the case of using epoxy resin, a step of heating and curing the filled resin is necessary, which makes production efficiency poor, and the epoxy resin itself is expensive. This may further increase the production cost. On the contrary, in this embodiment, watertightness can be ensured only by the outer housing 11 and the seal 50 without filling any potting material such as epoxy resin. Thus, a material cost and a processing cost can be reduced, while further reducing a production cost by avoiding a molding failure.

Formability can be improved by making the housing of the fluid or waterproof connector 10 from a plurality of members, i.e. the inner housing 20 composed of the female housing 21 and the male housing 30 and the outer housing 11 housing the inner housing 20, thereby contributing to a reduction in production cost. In addition, a design change and an application to an existing connector are easily possible if the construction of the inner housing 20 is changed according to the constructions and shapes of the busbar pieces 35 and/or the capacitor 40. Thus, general versatility can be improved.

Further, connecting the lead wires 42 of the capacitor 40 to the connecting portions 38 of the busbars 35 by welding improves connection reliability and contributes to both a weight saving of the waterproof connector 10 and a reduction in production cost. In recent years, solder used for soldering particularly has been progressively made lead-free in view of an environmental load. If the lead wires of the capacitor and the connecting portions of the busbar pieces are soldered using this lead-free solder, connection reliability may be reduced. On the contrary, in this embodiment, connection reliability can be improved by connecting the lead wires 42 of the capacitor 40 and the connecting portions 38 of the busbar pieces 35 by welding. Further, since the weight and material cost of the solder used in the case of soldering can be reduced, contribution can also be made to weight saving and a production cost reduction.

Furthermore, the pair of busbars 35 are held in the male housing 30 while substantially facing each other and the clamping pieces 39 projecting from the respective busbars 35 clamp or position the capacitor main body 41 of the capacitor 40 therebetween. Thus, the lead wires 42 and the connecting portions 38 of the busbars 35 can be welded with the capacitor 40 fixed to the male housing 30 to improve work efficiency.

The invention is not limited to the above described and illustrated embodiment. For example, the following embodiments also are included in the scope of the invention.

Although the housing is made of separate members, i.e. the outer and inner housings 11 and 20, it may be formed integrally or unitarily. This can reduce the number of parts of the waterproof connector 10, thereby reducing cost.

Although the capacitor 40 including the lead wires 42 is illustrated in the above embodiment, it may be in the form of a chip without being limited to this. Further, although the capacitor 40 and the busbars 35 are fixed by welding, they may be fixed, for example, by soldering or by gluing without being limited to this.

What is claimed is:

1. A fluidproof connector, comprising:

an electric element;

at least one busbar connected to the electric element, the busbar including tabs connectable to at least one mating terminal fittings connected to ends of wires;

a housing that houses the busbar and the electric element connected to the busbar, the housing having only one opening that opens in only one direction and holds the terminal fittings inserted through the opening to be connected to the tabs of the busbar;

an inner housing housed in the housing, a plurality of cavities formed in the inner housing and configured so that the tabs of the busbar are guided into the plurality of cavities, and locks projecting from the inner housing and at least partly forward of the opening of the housing;

a seal press-fit into the housing through the opening, the seal having through holes through which the wires are closely inserted and lock piece insertion holes penetrating the seal at opposite longitudinal sides of the through holes and configured to allow insertion of the locks therethrough; and a holder mounted to the housing to at least partly cover the opening and, the holder including engaging portions configured to engage the locks inserted through the lock piece insertion holes to retain and hold the seal.

2. The fluidproof connector of claim 1, wherein the at least one busbar comprises two busbars connected via the electric element.

3. The fluidproof connector of claim 2, wherein each of the busbars includes a plurality of tabs connectable to a corresponding plurality of mating terminal fittings connected to ends of wires, a coupling connecting the tabs to each other, and a connecting portion to be connected to an electrode of the electric element.

4. The fluidproof connector of claim 1, wherein the inner housing includes a male housing holding the busbars penetrating therethrough, and a female housing connected to the male housing and including at least one cavity for individually housing the at least one tab.

5. The fluidproof connector of claim 4, wherein the male housing includes a main portion for holding the busbars by insert molding and an electric element housing for housing the electric component by at least one support (33B) for supporting an element main body of the electric element in cooperation with a receiving portion of the outer housing.

6. The fluidproof connector of claim 2, wherein the electric element includes an element main body and two lead wires led out from the element main body, and the lead wires are connected to respective connecting portions of the busbars by welding.

7. The fluidproof connector of claim 6, wherein the busbars substantially face each other with the electric element arranged between the busbars.

8. The fluidproof connector of claim 6, wherein each busbar includes a cantilever-shaped clamping piece.

9. The fluidproof connector of claim 8, wherein the element main body is clamped between the busbars by the respective clamping pieces that are arranged to substantially face each other.

10. A fluidproof connector, comprising:

an inner housing having a male housing including a main portion, a receptacle projecting forward from the main portion and an electric element housing projecting rearward from the main portion and a female housing connected to the male housing and including at least one cavity formed therein and locks projecting forward from female housing;

two opposed busbars, each busbar having a coupling mounted in the main portion of the inner housing, tabs projecting forward from the coupling and into the cavities of the female housing and connecting portions projecting rearward from the coupling and into electric element housing;

an electric element in the electric element housing and connected to the connecting portions of the busbars;

an outer housing having a closed rear wall, a side wall projecting forward from the rear wall and an opening-opposite the rear wall, the inner housing being disposed in the outer housing so that the electric element housing faces the rear wall and the receptacle faces the opening;

a seal press-fit into the outer housing through the opening, the seal formed with lock piece insertion holes penetrating the seal and configured to allow insertions of the locks therethrough; and a holder mounted to the outer housing the holder covering the opening and including engaging portions configured to engage the locks inserted through the lock piece insertion holes to retain and hold the seal in the outer housing.

11. The fluidproof connector of claim 10, wherein the male housing includes the main portion for holding the busbars by insert molding so that the main portion defines a unitary matrix of resin surrounding and supporting the couplings.

12. The fluidproof connector of claim 10, wherein the electric element includes an element main body and two lead wires led out from the element main body, the lead wires being connected to respective connecting portions of the busbars.

13. The fluidproof connector of claim 12, wherein each busbar includes a clamping piece, the element main body being clamped between the busbars by the respective clamping pieces.

14. A fluidproof connector, comprising:

an inner housing having a male housing including a main portion, a receptacle projecting forward from the main portion and a capacitor housing projecting rearward from the main portion, the capacitor housing having a back surface formed at the main portion and supports projecting from the back surface;

an outer housing having a bottom wall with a receiving portion formed thereon, a side wall projecting forward from the rear wall and an opening opposite the bottom wall, the inner housing being disposed in the outer housing so that the capacitor housing faces the rear wall and the receptacle faces the opening;

a capacitor having a capacitor main body, the capacitor mounted in the capacitor housing so that the supports of the capacitor housing and the receiving portion of the outer housing support the capacitor main body;

two opposed busbars, each busbar having a coupling mounted in the main portion of the inner housing, tabs projecting forward from the coupling and into the receptacle of the inner housing and connecting portions projecting rearward from the coupling and connected to the capacitor;

a seal press-fit into the outer housing through the opening; and a holder mounted to the outer housing, the holder covering the opening and holding the seal in the outer housing.

* * * * *